US006571400B1

(12) United States Patent
Reid

(10) Patent No.: US 6,571,400 B1
(45) Date of Patent: Jun. 3, 2003

(54) TOILET BOWL WATER FLOW ADJUSTMENT SYSTEM

(76) Inventor: James C. Reid, 453 Monte Vista Dr., Woodland, CA (US) 95695

( * ) Notice: Subject to any disclaimer, the term of this patent is extended or adjusted under 35 U.S.C. 154(b) by 0 days.

(21) Appl. No.: 10/165,777

(22) Filed: Jun. 6, 2002

(51) Int. Cl.[7] ..... E03D 1/20
(52) U.S. Cl. ..... 4/364; 4/326; 4/346
(58) Field of Search ..... 4/364, 363, 346, 4/345, 324–325

(56) References Cited

U.S. PATENT DOCUMENTS

| | | | | | |
|---|---|---|---|---|---|
| 245,854 | A | * | 8/1881 | Moore | 4/364 |
| 390,204 | A | * | 10/1888 | Crawford | 4/346 |
| 3,487,476 | A | | 1/1970 | Stiern et al. | 4/40 |
| 3,820,170 | A | | 6/1974 | Kern et al. | 4/18 |
| 4,143,430 | A | * | 3/1979 | Joshi et al. | 4/324 |
| 4,868,933 | A | | 9/1989 | Chen | 4/355 |
| 5,067,180 | A | | 11/1991 | Figeroid | 4/326 |
| 5,333,332 | A | | 8/1994 | Kam | 4/326 |
| 5,881,399 | A | | 3/1999 | Kartoleksono et al. | 4/326 |
| 5,887,292 | A | | 3/1999 | Goren | 4/363 |
| 6,029,287 | A | | 2/2000 | Ge et al. | 4/354 |
| 6,212,699 | B1 | | 4/2001 | Tremblay | 4/415 |
| 6,247,192 | B1 | | 6/2001 | Bostoen | 4/415 |

* cited by examiner

*Primary Examiner*—Gregory L. Huson
*Assistant Examiner*—Huyen Le

(57) ABSTRACT

A toilet bowl water flow adjustment system for controlling the water volume utilized to flush an existing toilet. The toilet bowl water flow adjustment system includes a divider structure for separating a reservoir into a main portion and an auxiliary portion, a main arm pivotally attached to the divider structure, and an auxiliary flush valve connected to said main arm. The main arm has an engaging end that engages a lower portion of a handle arm of a conventional toilet that is connected to a main flush valve. When the handle connected to the handle arm is rotated clockwise thereby forcing the main arm to pivot thereby opening the auxiliary flush valve which allows the water within the auxiliary portion of the reservoir to pass into the main portion of the reservoir.

20 Claims, 5 Drawing Sheets

TOILET BOWL WATER FLOW ADJUSTMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to toilets and more specifically it relates to a toilet bowl water flow adjustment system for controlling the water volume utilized to flush an existing toilet.

2. Description of the Related Art

Toilets have been in use for years. A conventional toilet has a reservoir, a flush valve within the water reservoir, a bowl fluidly connected to the reservoir, and a filler valve. The reservoir may be capable of holding 3.5 gallons or more of water. To flush the toilet, the user presses down upon a handle mechanically connected to the flush valve which opens the flush valve. The water within the reservoir flows into bowl and out through a siphon passage until the bowl is emptied. The flush valve thereafter seals about the opening within the reservoir thereby allowing filling of the reservoir by the filler valve.

The main problem with conventional toilets is that significant volumes of water is wasted in flushing the toilet which are not required. Another problem with conventional toilets is that they increase the overall water consumption of a household. Another problem with conventional toilets is that they unnecessarily waste water.

Examples of patented devices which may be related to the present invention include U.S. Pat. No. 5,607,180 to Figeroid; U.S. Pat. No. 5,887,292 to Goren; U.S. Pat. No. 3,487,476 to Stiern et al.; U.S. Pat. No. 6,029,287 to Ge et al.; U.S. Pat. No. 5,881,399 to Kartoleksono et al.; U.S. Pat. No. 5,333,332 to Kam; U.S. Pat. No. 4,868,933 to Chen; U.S. Pat. No. 3,820,170 to Kern et al.; U.S. Pat. No. 6,212,699 to Tremblay; and U.S. Patent 6,247,192 to Bostoen.

While these devices may be suitable for the particular purpose to which they address, they are not as suitable for controlling the water volume utilized to flush an existing toilet. Conventional toilets often times do not allow for the control of water from the reservoir during flushing.

In these respects, the toilet bowl water flow adjustment system according to the present invention substantially departs from the conventional concepts and designs of the prior art, and in so doing provides an apparatus primarily developed for the purpose of controlling the water volume utilized to flush an existing toilet.

BRIEF SUMMARY OF THE INVENTION

In view of the foregoing disadvantages inherent in the known types of toilets now present in the prior art, the present invention provides a new toilet bowl water flow adjustment system construction wherein the same can be utilized for controlling the water volume utilized to flush an existing toilet.

The general purpose of the present invention, which will be described subsequently in greater detail, is to provide a new toilet bowl water flow adjustment system that has many of the advantages of the toilets mentioned heretofore and many novel features that result in a new toilet bowl water flow adjustment system which is not anticipated, rendered obvious, suggested, or even implied by any of the prior art toilets, either alone or in any combination thereof.

To attain this, the present invention generally comprises a divider structure for separating a reservoir into a main portion and an auxiliary portion, a main arm pivotally attached to the divider structure, and an auxiliary flush valve connected to said main arm. The main arm has an engaging end that engages a lower portion of a handle arm of a conventional toilet that is connected to a main flush valve. When the handle connected to the handle arm is rotated clockwise thereby forcing the main arm to pivot thereby opening the auxiliary flush valve which allows the water within the auxiliary portion of the reservoir to pass into the main portion of the reservoir.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a toilet bowl water flow adjustment system that will overcome the shortcomings of the prior art devices.

A second object is to provide a toilet bowl water flow adjustment system for controlling the water volume utilized to flush an existing toilet.

Another object is to provide a toilet bowl water flow adjustment system that reduces the total volume of water utilized by a toilet.

An additional object is to provide a toilet bowl water flow adjustment system that allows for a restricted flushing action with reduced water usage or a normal flushing action.

A further object is to provide a toilet bowl water flow adjustment system that may be easily installed within existing toilets.

Another object is to provide a toilet bowl water flow adjustment system that may be utilized within various sizes and types of toilets.

A further object is to provide a toilet bowl water flow adjustment system that conserves water.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
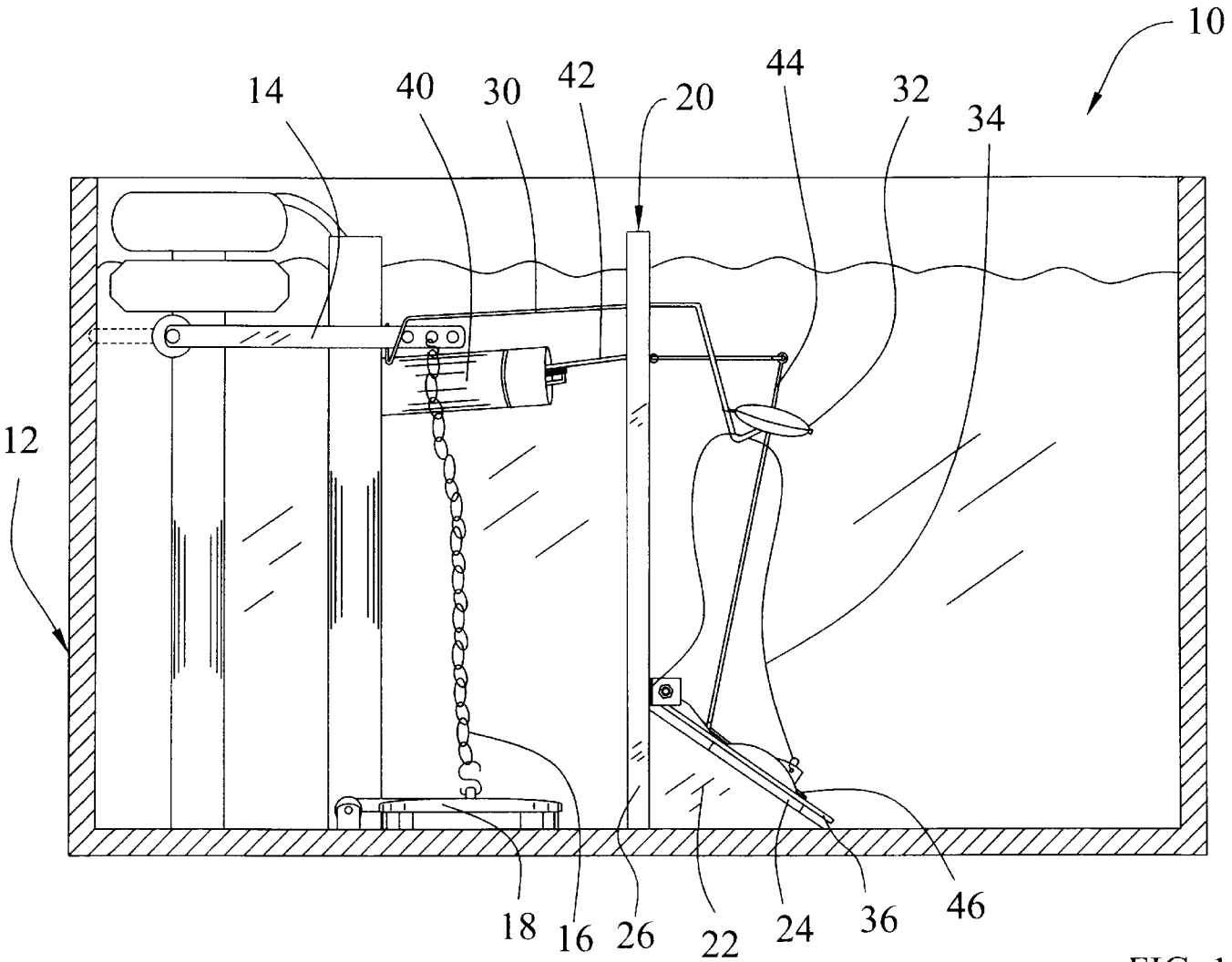
FIG. 1 is a side view of the present invention within a reservoir.

Turning now descriptively to the drawings, in which similar reference characters denote similar elements throughout the several views, FIGS. 1 through 5 illustrate a toilet bowl water flow adjustment system 10, which comprises a divider structure 20 for separating a reservoir 12 into a main portion and an auxiliary portion, a main arm 30 pivotally attached to the divider structure 20, and an auxiliary flush valve 36 connected to said main arm 30. The main arm 30 has an engaging end that engages a lower portion of a handle arm 14 of a conventional toilet that is connected to a main flush valve 18. The main flush valve 18 is connected to the handle arm 14 by a conventional flush connector 16. When the handle connected to the handle arm 14 is rotated clockwise thereby forcing the main arm 30 to pivot thereby opening the auxiliary flush valve 36 which allows the water within the auxiliary portion of the reservoir 12 to pass into the main portion of the reservoir 12.

Figure 4:
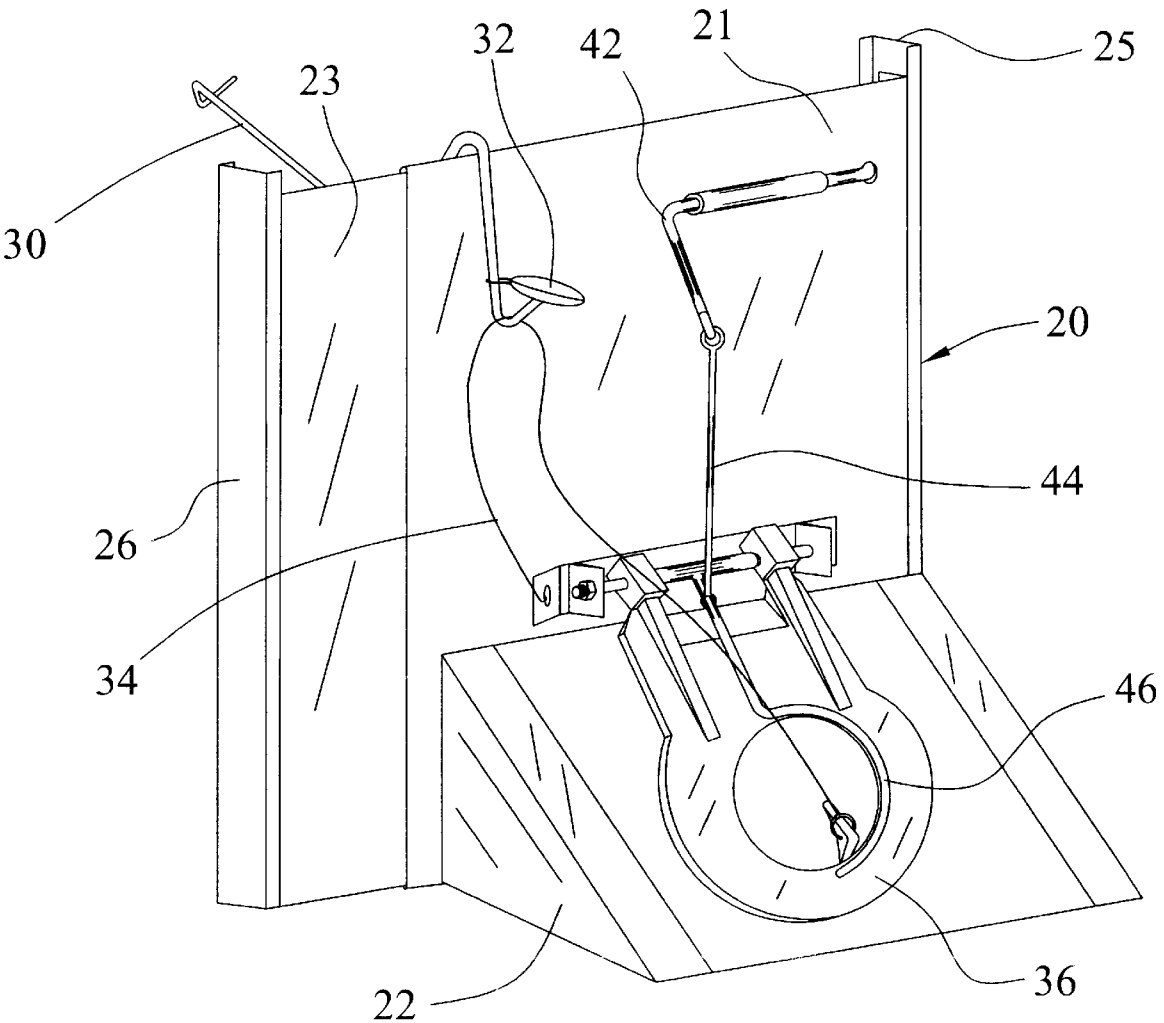
FIG. 4 is a right upper perspective view of the present invention.
Figure 5:
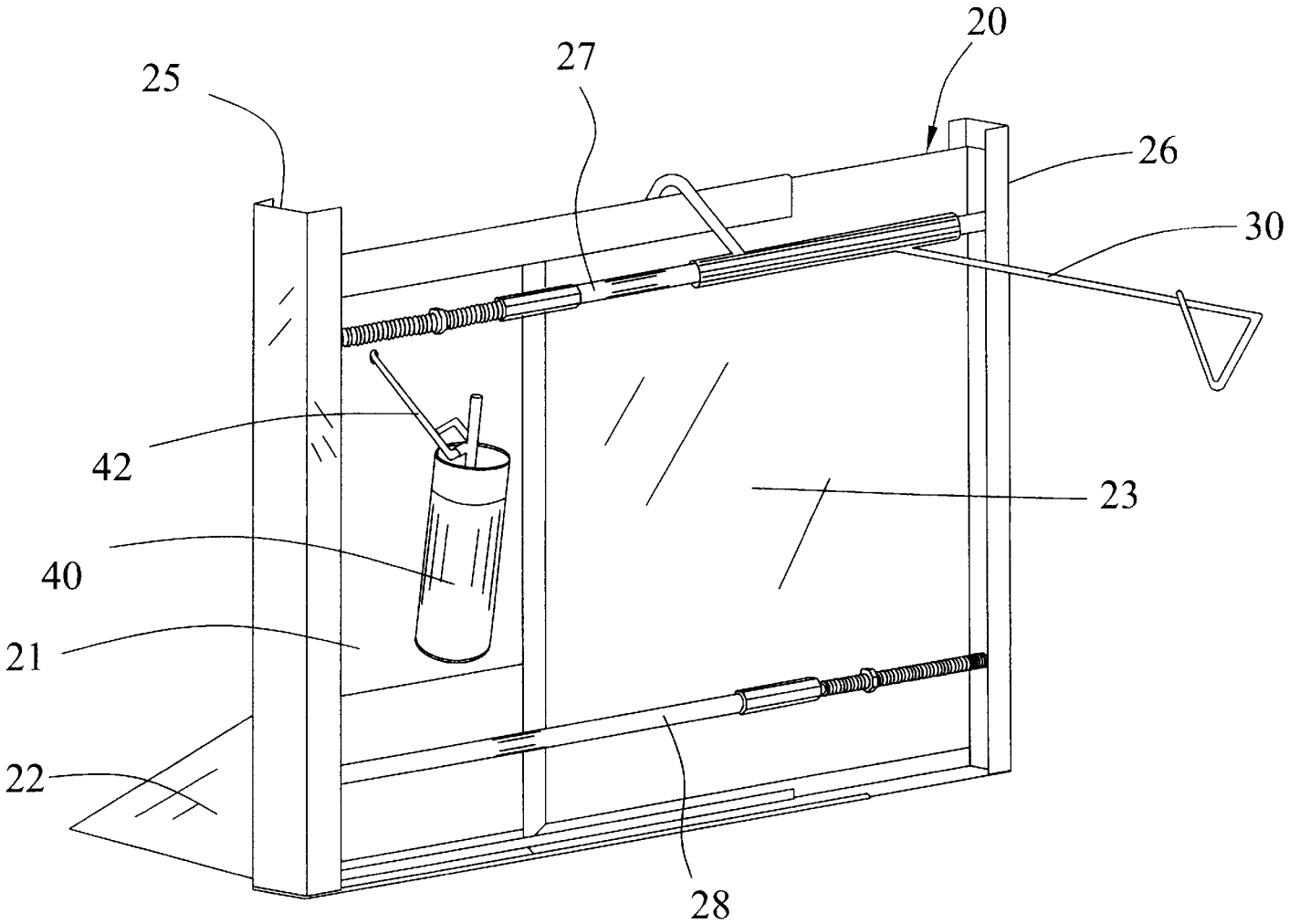
FIG. 5 is a left upper perspective view of the present invention.

As best shown in FIGS. 4 and 5 of the drawings, a divider structure 20 is provided for separating the reservoir 12 of the toilet. The divider structure 20 separates the reservoir 12 into a main portion which includes the main flush valve 18 and an auxiliary portion. The volume capacity of the main portion may be equal to, less than or greater than the volume capacity of the auxiliary portion depending upon the position of the divider structure 20 within the reservoir 12.

The divider structure 20 has a first end member 25 and a second end member 26 that are securely and sealably positioned against opposing inner walls of the reservoir 12. The first end member 25 and the second end member 26 may include a gasket structure for assisting in sealing with the inner wall of the reservoir 12. In addition, an adhesive or sealing material may be utilized within the end members 25, 26 to form a desired seal. The bottom edge of the divider structure 20 may also include a gasket structure and/or sealed with a sealing material. It is desirable to maintain a complete fluid separation between the main portion and the auxiliary portion on opposing sides of the divider structure 20, however it can be appreciated that a semi-permeable structure may accomplish a similar purpose assuming significant flows of water are not allowed to flow form the auxiliary portion to the main portion of the reservoir 12.

The divider structure 20 may be comprised of a solid wall or adjustable wall structure. FIGS. 4 and 5 illustrate an, adjustable wall structure for the divider structure 20. A first member 21 is slidably attached to a second member 23 which allows for the extension or contraction of the divider structure 20 to accommodate various sizes of reservoirs 12. FIG. 5 illustrates an upper lip and a lower lip extending from the first member 21 which slidably receives the second member 23. The end members 25, 26 are attached to the distal portions of the first member 21 and the second member 23 as shown in FIGS. 4 and 5 of the drawings.

One or more adjustable braces are preferably utilized within the divider structure 20 for maintaining a desired overall length of the divider structure 20. FIG. 5 illustrates the usage of an upper brace 27 and a lower brace 28 extending between the end members 25, 26 thereby maintaining a juxtaposed relationship with the opposing inner walls of the reservoir 12. The upper brace 27 and the lower brace 28 are preferably adjustable utilizing a threaded shaft within an interior threaded tube structure or other adjustable structure. Various other structures may be utilized to maintain a desired length for the divider structure 20 though not shown in the drawings.

As shown in FIGS. 1 through 5 of the drawings, a lower housing 22 is attached to the lower portion of the divider structure 20. The lower housing 22 surrounds a lower opening within the divider structure 20 which allows for the controlled passage of water from the auxiliary portion of the reservoir 12 to the main portion of the reservoir 12. An auxiliary opening 24 within the lower housing 22 is selectively sealed with an auxiliary flush valve 36 as shown in FIGS. 1 through 4 of the drawings. The auxiliary flush valve 36 is pivotally attached to the lower housing 22 or the divider structure 20. The auxiliary opening 24 provides a fluid connection between the auxiliary portion and the main portion of the reservoir 12 of the toilet.

Figure 2:
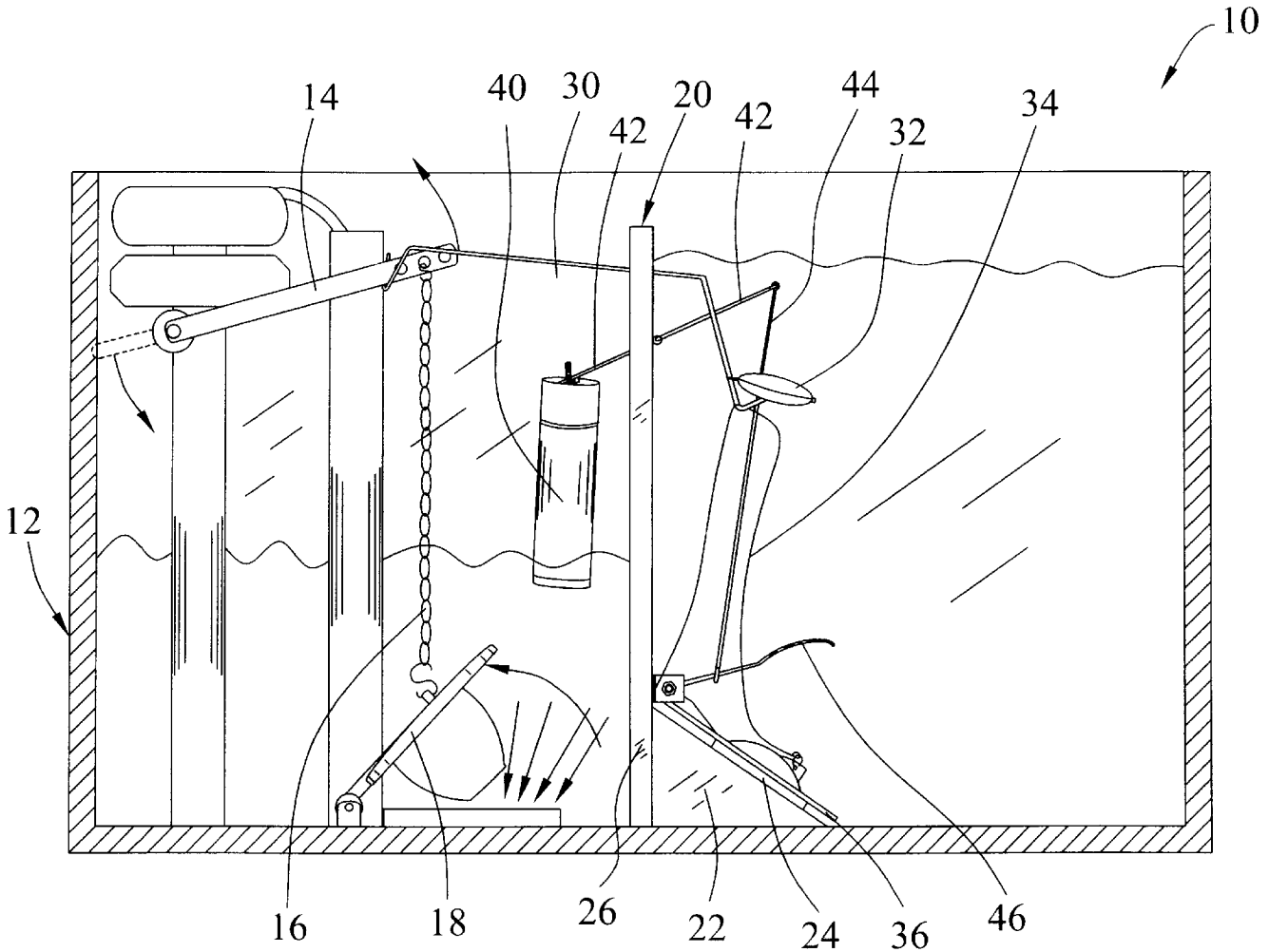
FIG. 2 is a side view of the present invention with the handle arm opening the main flush valve.
Figure 3:
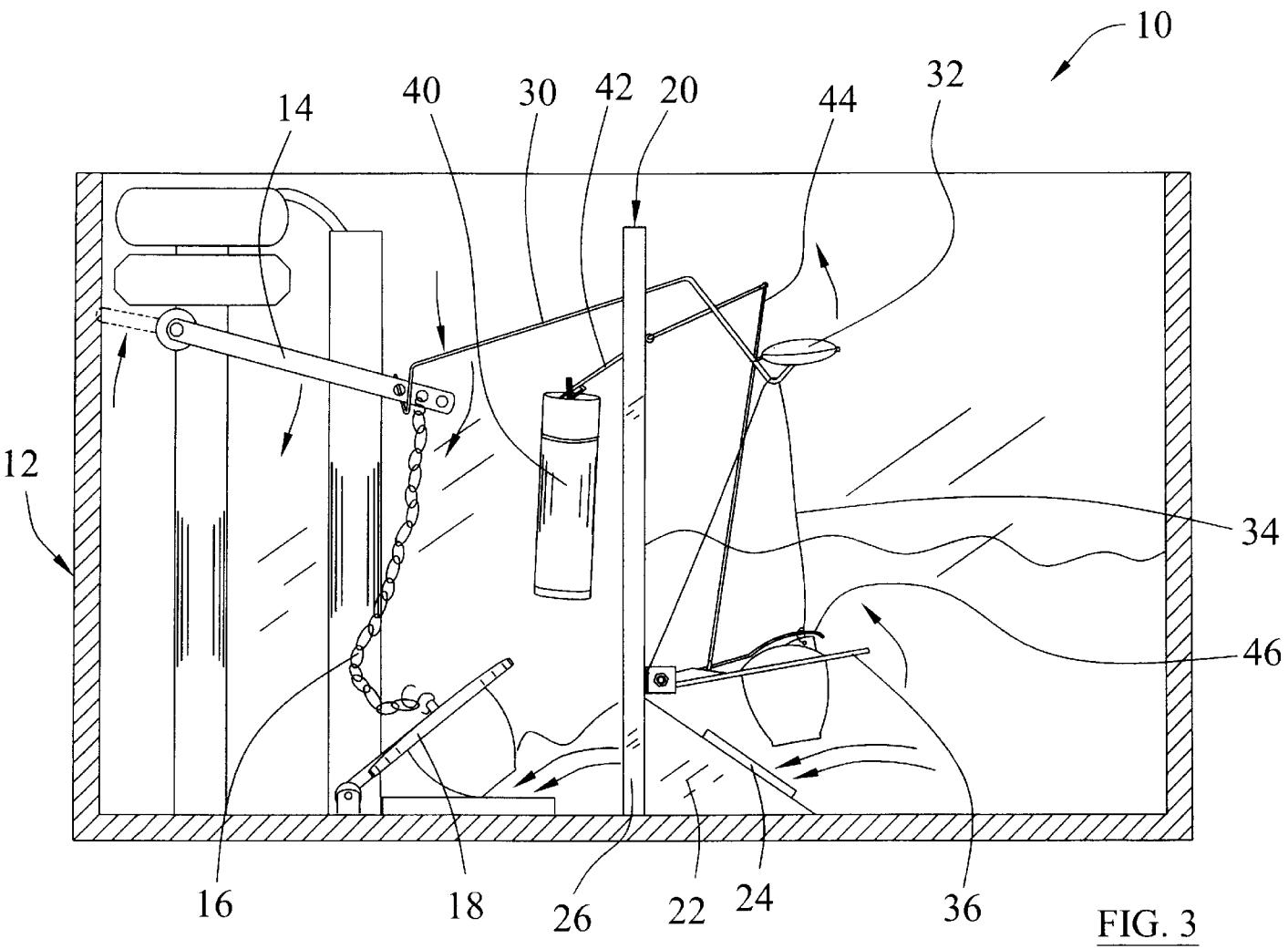
FIG. 3 is a side view of the present invention with the handle arm rotated clockwise thereby opening the auxiliary flush valve.

As shown in FIGS. 1 through 3 of the drawings, a main arm 30 is provided that has a hooked end for engaging a lower portion of a handle arm 14 of the toilet. The handle arm 14 is pivotally retained within an upper portion of the reservoir 12 and is controlled by a handle member which are conventional within the toilet industry. The hooked end preferably has an open V-shaped or U-shaped structure for allowing the handle arm 14 to freely rotate counterclockwise and for allowing the main arm 30 to freely slide along a portion of the handle arm 14. Various other attachment structures may be utilized to connect the main arm 30 to the handle arm 14 of the toilet.

The main arm 30 is pivotally attached to the divider structure 20 as shown in FIGS. 1 through 5 of the drawings. The main arm 30 may pivotally extend through an opening within the divider structure 20 or over the upper end of the divider structure 20. The distal end of the main arm 30 engages a connector line 34 which is connected to the auxiliary flush valve 36 for opening the auxiliary flush valve 36.

The connector line 34 is preferably slidably positioned about the distal portion of the main arm 30 with a first end attached to the divider structure 20 and the second end attached to the auxiliary flush valve 36 thereby requiring less movement of the main arm 30 to manipulate the auxiliary flush valve 36.

A weight member 32 is preferably attached to the distal portion of the main arm 30 for maintaining the main arm 30 in a clockwise position when not being manipulated by the handle arm 14. When the handle arm 14 is rotated clockwise, the main arm 30 is rotated counter-clockwise thereby opening the auxiliary flush valve 36 as shown in FIG. 3 of the drawings.

As further shown in FIGS. 1 through 3 of the drawings, a first float arm 42 is pivotally attached within the divider structure 20. A float member 40 is provided that is comprised of a buoyant structure such as foam or sealed air cavity. The float member 40 is attached to a distal end of the first float arm 42 as shown in FIGS. 1 through 3 and 5 of the drawings. The float member 40 is preferably pivotally attached to the first float arm 42 with an extended member from the float member 40 engaging the first float arm 42 when the float member 40 is approximately parallel to the first float arm 42 thereby increasing the pivoting of the first float arm 42.

A second float arm 44 is attached to the first float arm 42 opposite of the float member 40 upon the auxiliary portion side of the reservoir 12. The second float arm 44 extends downwardly and is attached to a retaining arm 46. The retaining arm 46 is pivotally attached to the divider and is formed for selectively engaging an upper surface of the auxiliary flush valve 36 for maintaining the auxiliary flush valve 36 in a sealed manner within the auxiliary opening 24 when the pressure difference between the main portion and the auxiliary portion is little (i.e. when the water levels within the main portion and the auxiliary portion are similar).

For restricted water flow usage for the toilet, the user simply rotates the handle attached to the handle arm 14 in a counter-clockwise manner thereby opening the main flush valve 18 within the reservoir 12 as shown in FIG. 2 of the drawings. The main portion of the reservoir 12 is thereby emptied of water for flushing the bowl with the auxiliary portion remaining at a full level as further shown in FIG. 2 of the drawings. It should be noted that the float member 40 when in the elevated position retains the auxiliary flush valve 36 in a closed position until a significant pressure difference results between the different water levels in the main portion and the auxiliary portion which then retain the auxiliary flush valve 36 in a closed position. The user releases the handle which allows the main flush valve 18 to close when the water level is relatively low within the main portion of the reservoir 12 thereby allowing filling of the main portion back to a normal water level.

For normal water flow usage for the toilet, the user first proceeds with the restricted water flow process as stated previously and as illustrated in FIG. 2 of the drawings. However, after rotating the handle of the toilet in a counter-clockwise manner which opens the main flush valve 18, the user then rotates the handle in a clockwise manner thereby causing the handle arm 14 to engage the main arm 30 which is rotated in a counter-clockwise manner as shown in FIG. 3 of the drawings. When the main arm 30 is rotated counter-clockwise, the auxiliary flush valve 36 is opened thereby allowing the water within the auxiliary portion to flow into the main portion as further shown in FIG. 3 of the drawings. After the water level within the main portion is lowered to a level allowing for the main flush valve 18 to close, the water level begins to increase within both the main portion and the auxiliary portion of the reservoir 12 via the fluid connection of the auxiliary opening 24. As the water level increases, the float member 40 rises within the main portion of the reservoir 12 thereby causing the retaining arm 46 to force and maintain the auxiliary flush valve 36 closed despite little pressure differences between the main portion and the auxiliary portion of the reservoir 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet bowl water flow adjustment system for usage within a toilet, said toilet bowl water flow adjustment system comprising:

a divider structure positionable within a reservoir of said toilet for fluidly separating the reservoir into a main portion and an auxiliary portion;

a main arm having a first end and a second end, wherein said main arm is pivotally attached to said divider structure and wherein said first end is attachable to a handle arm of said toilet such that a clockwise rotation of said handle arm causes said main arm to rotate in a counter-clockwise manner;

a lower housing having an auxiliary opening secured to said divider structure for providing selective fluid connection between said main portion and said auxiliary portion of said reservoir; and an auxiliary flush valve positionable within said auxiliary opening, wherein said auxiliary flush valve is connected to said second end of said main arm.

2. The toilet bowl water flow adjustment system of claim 1, wherein said first end of said main arm has a V-shaped structure for engaging a lower portion of said handle arm.

3. The toilet bowl water flow adjustment system of claim 1, wherein said first end of said main arm has a U-shaped structure for engaging a lower portion of said handle arm.

4. The toilet bowl water flow adjustment system of claim 1, including a weight member attached to said second end of said main arm.

5. The toilet bowl water flow adjustment system of claim 1, including a connector line extending from said second end of said main arm to said auxiliary flush valve.

6. The toilet bowl water flow adjustment system of claim 5, wherein an end of said connector line is attached to said divider structure and an opposing end is attached to said auxiliary flush valve slidably about said second end of said main arm.

7. The toilet bowl water flow adjustment system of claim 1, wherein said divider structure is comprised of a solid structure.

8. The toilet bowl water flow adjustment system of claim 1, wherein said divider structure has a first end member and a second end member sealably attachable between opposing inner walls of said reservoir of said toilet.

9. The toilet bowl water flow adjustment system of claim 1, wherein said divider structure is comprised of a telescoping structure.

10. The toilet bowl water flow adjustment system of claim 9, including at least one adjustable brace extending between opposing ends of said divider structure for maintaining a desired length of said divider structure.

11. A toilet bowl water flow adjustment system for usage within a toilet, said toilet bowl water flow adjustment system comprising:

a divider structure positionable within a reservoir of said toilet for fluidly separating the reservoir into a main portion and an auxiliary portion;

a main arm having a first end and a second end, wherein said main arm is pivotally attached to said divider structure and wherein said first end is attachable to a handle arm of said toilet such that a clockwise rotation of said handle arm causes said main arm to rotate in a counter-clockwise manner;

a lower housing having an auxiliary opening secured to said divider structure for providing selective fluid connection between said main portion and said auxiliary portion of said reservoir;

an auxiliary flush valve positionable within said auxiliary opening, wherein said auxiliary flush valve is connected to said second end of said main arm;

a float arm pivotally attached to said divider structure;

a retaining arm pivotally attached to said divider structure engageable with said auxiliary flush valve, wherein said retaining arm is connected to a distal end of said float arm; and a float member attached to said float arm opposite of said retaining arm and positioned within said main portion of said reservoir.

12. The toilet bowl water flow adjustment system of claim 11, wherein said first end of said main arm has a V-shaped structure for engaging a lower portion of said handle arm.

13. The toilet bowl water flow adjustment system of claim 11, wherein said first end of said main arm has a U-shaped structure for engaging a lower portion of said handle arm.

14. The toilet bowl water flow adjustment system of claim 11, including a weight member attached to said second end of said main arm.

15. The toilet bowl water flow adjustment system of claim 11, including a connector line extending from said second end of said main arm to said auxiliary flush valve.

16. The toilet bowl water flow adjustment system of claim 15, wherein an end of said connector line is attached to said divider structure and an opposing end is attached to said auxiliary flush valve slidably about said second end of said main arm.

17. The toilet bowl water flow adjustment system of claim 11, wherein said divider structure is comprised of a solid structure.

18. The toilet bowl water flow adjustment system of claim 11, wherein said divider structure has a first end member and a second end member sealably attachable between opposing inner walls of said reservoir of said toilet.

19. The toilet bowl water flow adjustment system of claim 11, wherein said divider structure is comprised of a telescoping structure.

20. A method of operating a toilet having a reservoir, a handle arm rotatably attached within said reservoir, a main flush valve connected to said handle arm, a divider structure positionable within said reservoir of said toilet for fluidly separating the reservoir into a main portion and an auxiliary portion, a main arm having a first end and a second end, wherein said main arm is pivotally attached to said divider structure and wherein said first end is attachable to said handle arm of said toilet such that a clockwise rotation of said handle arm causes said main arm to rotate in a counter-clockwise manner, a lower housing having an auxiliary opening secured to said divider structure for providing selective fluid connection between said main portion and said auxiliary portion of said reservoir, and an auxiliary flush valve positionable within said auxiliary opening, wherein said auxiliary flush valve is connected to said second end of said main arm, said method comprising the steps of:

(a) rotating said handle arm in a counter-clockwise manner thereby opening said main flush valve; and (b) rotating said handle arm in a clockwise manner thereby opening said auxiliary flush valve.

* * * * *